United States Patent [19]

Baker

[11] 4,007,391

[45] Feb. 8, 1977

[54] IGNITERS

[75] Inventor: Peter D. Baker, Basingstoke, England

[73] Assignee: Smiths Industries Limited, London, England

[22] Filed: Nov. 4, 1975

[21] Appl. No.: 628,639

[30] Foreign Application Priority Data

Nov. 4, 1974 United Kingdom ..... 47661/74

[52] U.S. Cl. ..... 313/131 A; 313/138

[51] Int. Cl.[2] ..... H01T 13/02

[58] Field of Search ..... 313/131 A, 131 R, 130, 313/138

[56] References Cited

UNITED STATES PATENTS 3,558,959 1/1971 Ziemendorf ..... 313/131 A

*Primary Examiner*—R. V. Rolinec
*Assistant Examiner*—Darwin R. Hostetter
*Attorney, Agent, or Firm*—Pollock, VandeSande and Priddy

[57] ABSTRACT

A surface-discharge igniter having concentric electrodes includes a gap at its operative tip which separates one of the electrodes from the exposed semiconductive surface of a semiconductive pellet that is interposed concentrically with the two electrodes. The said one electrode, which may be either the inner or outer electrode, is connected electrically to the pellet at the bottom of the gap away from the operative tip, whereas the other electrode makes contact with the pellet at, and in the region of, the exposed surface but is otherwise insulated electrically from it. Where the gap separates the inner electrode from the semiconductive surface then the outer electrode may be flared inwardly to establish its electrical connection with that surface. On the other hand, where the gap separates the outer electrode from the semiconductive surface the inner electrode may be flared outwardly, or provided with a cap that extends outwardly across the surface, to establish the connection with it. Holes for draining the gap may be provided through the outer electrode, and the pellet, which may be of material including silicon-carbide particles, may be brazed to the electrodes.

12 Claims, 6 Drawing Figures

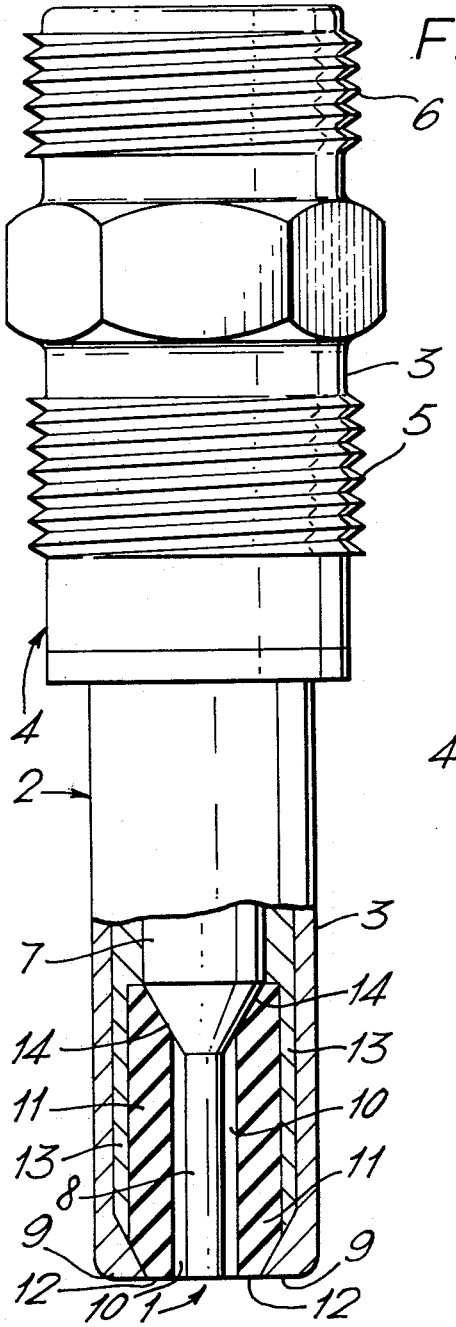
Fig.1.
Fig.2.
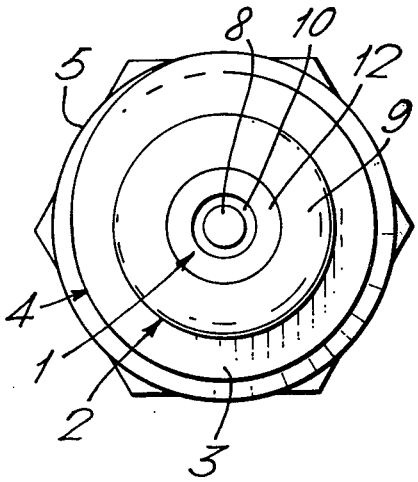

IGNITERS

This invention relates to igniters.

The invention is particularly concerned with igniters of the kind in which semiconductive material is interposed between two electrodes to provide at the operative tip of the igniter an exposed semiconductive surface across which electrical discharge between the electrodes takes place in operation. Igniters of this kind, which are commonly referred to as surface-discharge igniters, are used in gas-turbine engines for igniting and maintaining combustion of the fuel-air mixture in the combustion chamber.

With known forms of surface-discharge igniter both electrodes contact the exposed semiconductive surface at the operative tip and application of high voltage between the electrodes causes the electrical discharge required to ignite the fuel-air mixture to take place across that exposed surface. The operative tip of the igniter is located in the combustion chamber of the engine, and the semiconductive material and the electrodes are in consequence subject to adverse conditions leading to erosion and contamination.

Erosion of the semiconductive surface in general results in an increase in the threshold voltage required to initiate discharge between the two electrodes, and contamination of the operative tip of the igniter by fuel and the by-products of combustion, may add to this. Thus with continued use of the igniter in an engine installation there tends to be a progressive increase in the threshold voltage that is required to produce and maintain ignition. Eventually there will be either failure to produce a discharge, or to produce a discharge of sufficient energy to ignite the fuel-air mixture in the engine combustion-chamber.

It is an object of the present invention to provide an igniter of the surface-discharge kind that is less susceptible to failure or degradation in the above respects.

According to the present invention there is provided an igniter wherein semiconductive material is interposed between two electrodes to provide at the operative tip of the igniter an exposed semiconductive surface, and wherein one of the electrodes is separated by a gap from the semiconductive surface and is connected to the semiconductive material at the bottom of the gap away from the tip.

With the igniter of the present invention a substantial proportion of voltage applied between the electrodes will be effective across the gap. A high potential-gradient can thereby be readily established across the gap to produce a discharge in the gap that will initiate a main discharge across the semiconductive surface between the two electrodes sufficient to ignite the fuel-air mixture. In general the potential gradient across the gap remains to a significant extent unaffected by erosion and contamination arising from continued operation of the igniter, so that the threshold voltage required to initiate discharge accordingly tends to remain substantially constant. This enables a longer operational life of the igniter to be achieved than is obtainable in general experience with known forms of surface-discharge igniter.

The electrodes of the igniter of the present invention may be concentric with one another, and in these circumstances the gap may be provided as a gap concentric with the electrodes. The gap may separate either the inner or the outer of the two electrodes from the semiconductive surface at the operative tip.

A form of igniter in accordance with the present invention, together with various modifications of this form, all for use in a gas-turbine engine, will now be described, by way of example, with reference to the accompanying drawings, in which:-

FIG. 1 is a part-sectional elevation of the igniter;

FIG. 2 is an end view of the operative tip of the igniter of FIG. 1; and

Figure 3:
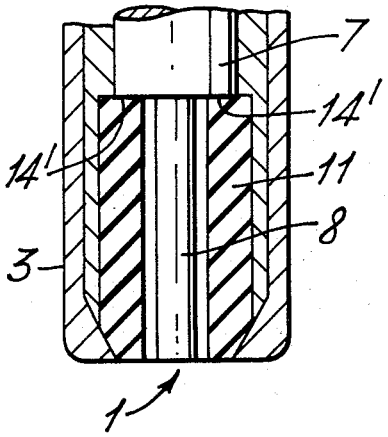
FIGS. 3 to 6 illustrate the various modifications of the form of igniter of FIGS. 1 and 2.

Referring to FIGS. 1 and 2, the operative tip 1 of the igniter is located at one end of a substantially cylindrical hose 2 of a tubular metal shell 3. The shell 3 above the nose 2 is of enlarged diameter to form a head 4. Screw threads 5 on the head 4 are provided for use in mounting the igniter in the gasturbine engine with the nose 2 projecting into the combustion chamber.

Screw threads 6 are also provided on the head 4 for engagement by an electrical connector (not shown) that serves to establish an electrically 'live' connection within the head 4, as well as an earth or ground connection with the shell 3. The 'live' connection is made with a metal rod 7 which is electrically insulated from the shell 3 and which extends axially along the nose 2 to provide the central electrode 8 of the igniter at the tip 1. The other, outer electrode of the igniter is provided by the rim 9 of the shell 3 at the tip 1, the electrode 8 being separated from this by an annular gap 10 and an annular body or pellet 11 of semiconductive material that is fitted tightly into the nose 2 coaxially with the electrode 8.

The rim 9 of the shell 3 is inwardly flared, and the pellet 11 abuts hard onto the flared rim 9 to establish good electrical connection between the outer electrode and the exposed semiconductive surface 12 of the pellet 11. Elsewhere the pellet 11 is insulated electrically from the shell 3 by interposing insulating material 13, so that electrical connection of the outer electrode 9 with the pellet 11 is confined to the region of the exposed semiconductive surface 12 at the tip 1. Electrical interconnection of the central electrode 8 with the pellet 11 is on the other hand confined to the region of the bottom of the gap 10 where the pellet 11 is abutted by a flared shoulder 14 of the electrode 8. Thus the semiconductive material is in electrical contact with the two concentric electrodes 8 and 9 of the igniter at opposite ends of the gap 10, being in contact with the outer electrode 9 at the exposed, operative tip 1, and with the inner, central electrode 8 at the bottom of the gap 10 concentric with the two electrodes.

The gap 10, which has a width of approximately 0.01 centimetre and a depth of some 0.5 to to 0.7 centimetre, is effectively connected in the igniter in parallel with the main body of the pellet 11. More particularly, the gap 10 is effectively connected between the exposed surface 12 and the electrode 8, in parallel with the main body of the pellet 11 to the flared shoulder 14 of the electrode 8. When voltage (for example of some 2 kilovolts) is applied between the electrode 8 and the grounded shell 3, a very substantial proportion (for example, some 90%) of this voltage is effective across the gap 10. The high potential-gradient thereby established across the gap 10 produces ionisation that rapidly leads to discharge in the gap 10 between the electrode 8 and the pellet 11 at the tip 1. This initiates a main discharge across the exposed semiconductive surface 12 between the electrodes 8 and 9, suffient to ignite the fuel-air mixture in the conbustion chamber of the engine.

Repeated operation of the igniter in the conditions prevailing in the combustion chamber of the engine, inevitably leads to erosion of the electrodes 8 and 9 and of the semiconductive pellet 11. Erosion of this nature with the construction of igniter described with reference to FIGS. 1 and 2, is however in general only effective to produce progessive recession into the igniter body of the contact between the outer electrode 9 and the exposed semiconductive surface 12 of the pellet 11, and of the point at which initial discharge across the gap 10 takes place.

The effective width of the deep gap 10, and therefore the high potential gradient established across the gap 10 to initiate discharge and bring about ignition, remains substantially unaffected by erosion of the opposed portions of the pellet 11 and electrodes 8 at the tip 1, the point of the initial discharge simply moving deeper into the gap 10 as erosion of these portions progresses. Erosion there and at the outer electrode 9 produces a small redistribution across the space between the electrodes 8 and 9 of the applied voltage, but this will in general have only minimal effect on the magnitude of the potential difference across the gap 10. The threshold voltage required to initiate discharge accordingly remains substantially constant, and a theoretical limit on continued operation occurs when erosion has proceeded so far that electrical contact between the electrode 9 and the semiconductive surface 12 is broken. But in any case the construction of igniter described above can be expected in practice to provide a longer operational life than is in general experienced in comparable circumstances with conventional forms of surface-discharge igniter.

Figure 4:
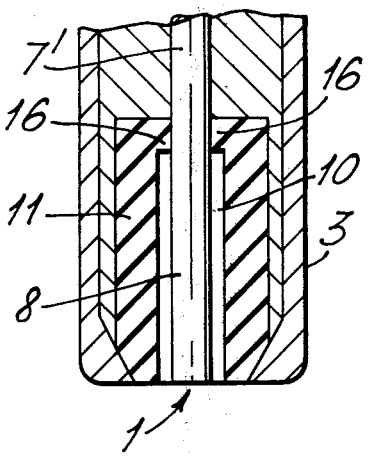

The operational advantages of the present invention referred to above can be achieved using electrode and pellet constructions different from those described with reference to FIGS. 1 and 2. More particularly, as illustrated in FIG. 3, the flared shoulder 14 may be dispensed with, the pellet 11 being abutted at the bottom of the gap 10 in this case by a right-angled shoulder 14' where the diameter of the rod 7 is reduced to form the central electrode 8. On the other hand, the provision of a shoulder can be avoided altogether, as illustrated in FIG. 4, where the rod 7 is replaced by a metal rod 7' of the same diameter throughout its length, and where contact between the electrode 8 and the pellet 11 at the bottom of the gap 10 is provided by an inwardly-thickened extension 16 of the pellet 11.

With the constructions so far described it is the central electrode 8 rather than the outer electrode provided by the shell 3, that is separated by the gap 10 from the semiconductive pellet 11 at the operative tip 1. The gap may however separate the outer electrode from the semiconductive material at the operative tip, without any significant change in operation, the high potential gradient across the gap being in this case established simply with the outer electrode to produce the initiating discharge, rather than with the central electrode. Two modifications of the igniter in this respect, are illustrated in FIGS. 5 and 6.

Figure 5:
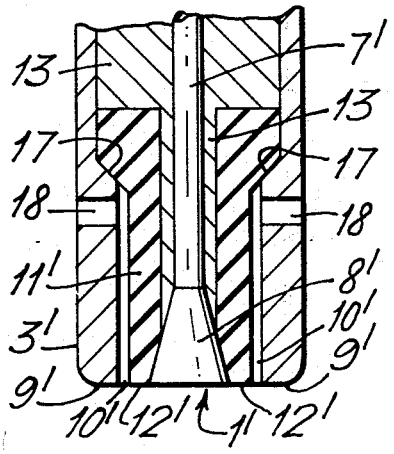

Referring to FIG. 5, the central electrode 8' in this case is flared outwardly at the operative tip 1'. The semiconductive material is provided by an annular pellet 11' that abuts hard onto the flaring of the central electrode 8', but is elsewhere insulated electrically from the electrode 8' by the material 13. The pellet 11' is shaped to abut onto an inwardly-flared shoulder 17 within the outer metal shell 3' of the igniter. An annular gap 10', having a width of approximately 0.01 and depth of some 0.5 to 0.7 centimetre, separates the pellet 11' from the shell 3' throughout a substantial part of the length of the pellet 11' to the unflared rim 9' of the shell 3', at the operative tip 1'. Holes 18 are drilled through the metal shell 3' at spaced positions around its circumference to enable any fuel trapped in the gap 10' to drain away.

Figure 6:
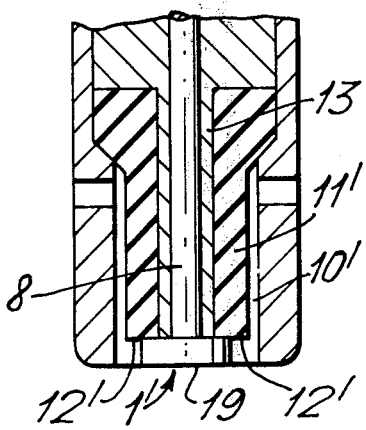

The modification involved in the arrangement of FIG. 6 is similar to that of FIG. 5, but here the exposed surface 12' of the pellet 11' is recessed slightly into the shell 3' at the operative tip 1', to afford it a degree of protection from the corrosive environment of the combustion chamber. In addition, the central electrode 8, rather than being flared, is provided with an end cap 19 onto which the exposed semiconductive surface 12' of the pellet 11' abuts directly.

The semiconductive pellet used in any of the constructions described above, may be a sintered pressing of silicon-carbide material. More particularly, the pellet may be a sintered compacted-body of silicate-coated silicon-carbide particles, manufactured in accordance with the method described in U.S. patent application Ser. No. 570,328 of Kenneth A. Goreham and John R. Perry, filed Apr. 21, 1975. The pellet resistance should be low enough to enable an adequate ionisation current to flow during the initial discharge across the gap, but large enough to conserve energy for the subsequent, main discharge. The resistance measured between the contact surfaces of the pellet preferably lies between 100 kilohm and 1 Megohm.

Contact, both mechanical and electrical, between the electrodes and the pellet may be enhanced by brazing. In this respect, the contacting areas of the pellet may be coated with, for example, zirconium hydride before brazing.

The electrically-insulative material 13 used in the constructions of igniter described above may be glass or an insulative metal-oxide, or combinations of these. However mica may be used.

I claim:

1. In an igniter in which semiconductive material is interposed between two electrodes to provide at the operative tip of the igniter an exposed semiconductive surface across which electrical discharge between the electrodes takes place in operation, the improvement wherein one of the electrodes is separated by a gap from the semiconductive surface, and said one electrode is connected to the semiconductive material at the bottom of the gap away from said tip.

2. An igniter according to claim 1 including means confining electrical connection of the other electrode with the semiconductive material to a region including said surface at the operative tip.

3. An igniter according to claim 1 wherein said electrodes are concentic with one another, and wherein said gap is an annular gap concentric with the electrodes.

4. An igniter according to claim 3 wherein the inner of the two electrodes is separated by said gap from the semiconductive surface at the operative tip, and wherein the outer electrode is flared inwardly at the tip to establish electrical contact with the said semiconductive material.

5. An igniter according to claim 3 wherein the outer of the two electrodes is separated by said gap from the semiconductive surface at the operative tip, and wherein the inner electrode is flared outwardly to establish electrical contact with the said semiconductive material.

6. An igniter according to claim 3 wherein the outer of the two electrodes is separated by said gap from the semiconductive surface at the operative tip, and wherein the inner electrode has a cap portion that extends outwardly across said surface to establish electrical contact with the said semiconductive material.

7. An igniter according to claim 3 wherein the outer of the two electrodes is separated by said gap from the semiconductive surface, and the outer electrode has at least one hole therethrough for draining the gap.

8. An igniter according to claim 1 wherein the electrodes are brazed to the semiconductive material.

9. An igniter having an operative tip at which electrical discharge is to take place in operation, said igniter comprising an inner electrode, an outer electrode concentric with the inner electrode at the operative tip of the igniter, an annular pellet of semiconductive material interposed concentrically with the two electrodes to provide a semiconductive surface between them at the operative tip, means defining a gap opening at the operative tip between the pellet and one of the two electrodes so as to separate the said one electrode from said surface at the tip, means establishing electrical connection of the said one electrode with said pellet at the bottom of the gap away from said tip, means establishing electrical connection of the other of said two electrodes with the said pellet at said surface, and means insulating the said other electrode electrically from the pellet away from said tip.

10. An igniter according to claim 9 wherein the said one electrode is the said inner electrode.

11. An igniter according to claim 9 wherein said one electrode is the said outer electrode.

12. An igniter according to claim 9 wherein said semiconductive material includes silicon carbide.

* * * * *